US006296034B1

(12) United States Patent
Kodera et al.

(10) Patent No.: US 6,296,034 B1
(45) Date of Patent: Oct. 2, 2001

(54) IMAGE-FORMING MATERIAL REMOVING APPARATUS

(75) Inventors: Tetsuro Kodera; Tadakazu Edure, both of Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/229,174

(22) Filed: Jan. 13, 1999

(30) Foreign Application Priority Data

Jan. 20, 1998 (JP) ..... 10-008620

(51) Int. Cl.[7] ..... B44C 1/16; B44C 31/00; B05C 1/00; B41F 35/00; G03D 5/06

(52) U.S. Cl. ..... 156/540; 156/389; 156/584; 156/230; 156/247; 156/344; 118/60; 118/70; 118/106; 101/423; 15/3.53; 15/102

(58) Field of Search ..... 156/230, 241, 156/247, 277, 289, 281, 329, 340, 584, 256.51, 256.52, 359, 344, 378, 478, 540; 118/60, 70, 106; 101/423, 424; 15/1.51, 3.53, 97.1, 102, 103.5

(56) References Cited

U.S. PATENT DOCUMENTS 5,006,189 * 4/1991 Tsukamoto et al. ..... 156/247
5,621,939 * 4/1997 Yoshida et al. ..... 15/77
5,642,550 * 7/1997 Muruyama et al. ..... 15/102
5,689,754 * 11/1997 Yoshida et al. ..... 399/1
5,970,272 * 10/1999 Kobayashi et al. ..... 399/1
6,047,758 * 4/2000 Kuramoto et al. ..... 156/540
6,076,218 * 6/2000 Taniguchi et al. ..... 15/102
6,115,579 * 9/2000 Taniguchi et al. ..... 399/411

FOREIGN PATENT DOCUMENTS

A-4-64472 2/1992 (JP) .
A-4-116000 4/1992 (JP) .
A-7-36329 2/1995 (JP) .

* cited by examiner

*Primary Examiner*—Richard Crispino
*Assistant Examiner*—J. A. Lorengo
(74) *Attorney, Agent, or Firm*—Oliff & Berridge, PLC

(57) ABSTRACT

An image-forming material removing apparatus capable of continuously peeling image-forming material such as toner from the recording medium while, with simple structure, maintaining high quality will be provided. The image-forming material removing apparatus for removing the image-forming material from a recording medium on which the image-forming material containing hot-melt resin has melted and adhered, comprising: an image peeling member provided with an image peeling layer containing hot-melt resin on the surface of a heat-resisting base material; a first heating member for heating the image peeling layer into a softened or molten state; a contacting unit that causes the image peeling layer which has been heated by the first heating member and brought into a softened or molten state to come into contact with a recording medium onto whose surface the image-forming material has adhered; a separating unit that separates the recording medium from the image peeling layer in a state in which the image-forming material adhered to the image peeling layer has been moved onto the surface thereof; and a second heating member for heating the image peeling layer separated from the recording medium into a molten state.

15 Claims, 5 Drawing Sheets

IMAGE-FORMING MATERIAL REMOVING APPARATUS

BACKGROUND OF THE INVENTION

The present invention relates to an image-forming material removing apparatus for peeling image-forming material from a recording medium on which an image has been formed using image-forming material containing hot-melt resin by means of the electrophotography method, the heat transfer method or the like, to render it reusable.

In recent years, an attempt has been made to reuse a large amount of sheets used by copying apparatuses, printers and the like for reasons of interest in environmental issues. Currently, a method is generally used to collect sheets once utilized as wastepaper, to beat them into fiber once in a paper mill to remove toner or ink, and thereafter to make paper as sheets again. This method, however, requires the same amount of energy as in making entirely new paper, and moreover energy and costs for transportation are added, and therefore, it does not necessarily follow that the load is small for the environment.

As an apparatus for solving such a problem, there has conventionally been known an image-forming material removing apparatus for peeling an image from a recording sheet to which image-forming material has been melted and adhered once. It is described in, for example, the Japanese Published Unexamined Patent Application Nos. 4-64472 and 7-36329.

In these apparatuses, there are used sheets, which have been processed so as to reduce the adhesive force with toner in advance, or toner is peeled from the recording sheets by coating the interior of the image-forming material removing apparatus with a solution for promoting the peeling property of toner to thereby reduce the adhesive force between recording sheets and toner, and by causing an image peeling medium having great adhesive force with toner to come into contact.

In the foregoing image-forming material peeling apparatus, a member obtained by layer-forming hot-melt resin on the base material in the same manner as toner is often used as an image peeling member. In this case, there is an advantage that the toner thus peeled can be used as it is as an image peeling medium in the next cycle, and the peeling process can be continuously performed.

In such an image-forming material removing apparatus, in such a roll-type image peeling member as disclosed in, for example, the Japanese Published Unexamined Patent Application No. 7-36329, there is provided a heating member at a place within the image peeling roll, and in such a belt-type image peeling member as disclosed in the Japanese Published Unexamined Patent Application No. 4-64472, there is provided a heating member at a place within a heat roll opposite to a pressing roll which presses the image peeling layer against the recording sheet. This heating member controls the image peeling layer so that the temperature at the portion of the image peeling layer, which is pressed against the recording sheet, becomes a desired temperature.

The property of the hot-melt resin constituting the image peeling layer varies with temperatures. More specifically, it is in a solidified state at temperatures of the glass transition point or less, in a rubber-like, softened state having elasticity at temperatures from the glass transition point to melting point, and in a molten state having the property of liquid at the melting temperature or more. Therefore, the temperature at the image peeling layer on causing it to come into contact with toner on the recording sheet must be set within an appropriate temperature range because when the temperature is too low and the image peeling layer is in a solidified state, no adhesive force is produced between the layer and toner on the recording sheet whereas when the temperature is too high, the image peeling layer including toner on the recording sheet enters a low-viscosity state, and permeates through the recording medium. When the image peeling layer is caused to come into contact in a softened state, the peeling property is usually high.

When such an image peeling layer is continuously used, toner peeled accumulates on the image peeling layer, the thickness of the layer entirely increases, and both a place where more toner accumulates and a place where less toner accumulates are formed, thus leading to a problem that projections and depressions on the surface increase.

When the thickness of the layer becomes thick, the temperature profile on the peeling layer in the direction of the thickness becomes large, the interior is in a molten state even if the surface is in a softened state, and defects such as the peeling layer shifting to the recording medium occur. Therefore, the image peeling layer, which has exceeded a certain thickness, is replaced with a new one, or as disclosed in the Japanese Published Unexamined Patent Application No. 4-116000, the sheet is caused to come into contact at a higher temperature than that of the image peeling layer to transfer it onto the sheet for thereby removing a part thereof.

Also, when projections and depressions occur on the surface of the peeling layer, the contact with the recording sheet becomes uneven, causing defective peeling. With respect to such a phenomenon, as disclosed in the Japanese Published Unexamined Patent Application No. 7-36329, a pressure member has been adapted to be pressed against the surface of the image peeling layer so as to smooth the projections and depressions of the toner.

In such an image removing apparatus, however, since the toner peeled by the image peeling layer is collected by causing the sheet to come into contact at high temperatures during the peeling operation to transfer a part of the image peeling layer onto the sheet, the thickness of the peeling layer greatly changes between before and after the transfer onto the sheet, and it was difficult to maintain the peeling performance. Also, it is difficult to separate the toner from a collection sheet, and the collection sheet cannot be reused, and therefore, the sheets are reused with a large amount of collection sheets ending up being scrapped, making it hardly suitable to say that the load on the environment is reduced. Also, timing at which the collection sheet is fed also must be set by detecting the thickness of the image peeling layer, and the apparatus will become complicated because a storage tray for collection sheets, a peeling layer thickness measuring device and the like are required.

Further, the surface properties of the image peeling member will be studied. As regards toner peeled from the recording sheet, the side, which adhered to the sheet on the image peeling member, is exposed to the surface. Therefore, on the portion, to which the peeled toner adhered, there exist projections and depressions corresponding to the thickness of the image (adhered toner) and further on the surface of the projections, there also exist projections and depressions of the recording material (for example, fiber of the sheet), which adhered thereto, as a replica. In a conventional image removing apparatus having a heating member only at one place, since, in order to satisfy the peeling condition, the highest temperature of resin in the image peeling layer in one cycle can be increased only up to the softened state at a point of time whereat it is pressed against the recording sheet, it is not much more than large undulation in an image level that can be smoothed even if the pressure member is pressed against the surface of the image peeling layer, and such microscopic projections and depressions as seen in the projections and depressions on the surface of paper could not be completely smoothed. Therefore, in the image peeling layer in a portion from which toner has been once peeled, the surface smoothness could not be completely restored before the next cycle, and no sufficient adhesive force was generated, possibly causing defective peeling.

The present invention has been achieved in the light of the foregoing, and is aimed to provide an image-forming material removing apparatus capable of continuously peeling toner from a recording medium while, with simple structure, maintaining the material's high quality.

SUMMARY OF THE INVENTION

After studying earnestly, the present inventor et al. found that the foregoing problem could be solved by controlling the heating conditions for the image peeling layer to maintain its surface to be in a suitable state all the time, and completed the present invention.

More specifically, an image-forming material removing apparatus according to the present invention is (1) an image-forming material removing apparatus for removing the image-forming material from a recording medium, to which the image-forming material containing hot-melt resin has been melted and adhered, comprising: an image peeling member provided with an image peeling layer containing hot-melt resin on the surface of a heat-resisting base material; a first heating member for heating the foregoing image peeling layer to a softened or molten state; a contacting unit that causes the image peeling layer which has been heated by the foregoing first heating member and brought into a softened or molten state to come into contact with a recording medium onto whose surface the image-forming material has adhered; a separating unit that separates the recording medium from the image peeling layer in a state in which the image-forming material adhered to the image peeling layer has been moved on the surface thereof; and a second heating member for heating the image peeling layer separated from the recording medium to a molten state.

According to this structure, the image peeling layer made of hot-melt resin provided on the image peeling member is caused by the first heating member to be in a molten state or in a softened state, which has higher viscosity than the molten state, and is caused to be press-contacted with the recording medium, on which recording has been performed. Therefore, the image peeling layer and the toner constituting the image are firmly adhered to each other in a press-contacted portion, and it is possible to completely peel the image-forming material by separating the recording medium.

At the same time, even when the surface of the image-forming material on the recording medium on the image peeling member is rough, the image-forming material, which has advanced in a heating area using a second heating member, enters a molten state together with the image peeling member. Therefore, the surface becomes a gloss surface by the surface tension of the hot-melt resin, and it becomes possible to continuously peel image-forming material in high quality, with less sensitive to the projections and depressions of the image itself, and without resulting in complicated apparatus due to a smoothing member, a cleaner and the like.

(2) If a recording medium, onto which image-forming material containing hot-melt resin has been melted and adhered, is a fibrous or porous recording medium, the heating condition for the foregoing first heating member is preferably within a temperature range in which the image peeling layer is made into a softened state.

According to this structure, since the image peeling layer is in a softened state having higher viscosity than in a molten state in a heating area using the first heating member, when the image peeling layer is caused to press-contact with a porous or fibrous recording medium, firm adhesion between the image peeling layer and the image-forming material is achieved, and it is possible to peel the image-forming material from the recording medium in high quality without the image-forming material permeating through microscopic holes or fibrous interior of the recording medium.

In this respect and specifically, in the present invention, it has been confirmed that to "heat the image peeling layer into a molten state" can be achieved by controlling the surface temperature (M) of hot-melt resin constituting the image peeling layer within a range of $mp+10 \leqq M$ where the melting point of the hot-melt resin is mp and the glass transition point is Tg. Similarly, to "heat the image peeling layer into a softened or molten state" can be achieved by setting the surface temperature (M) within a range of $Tg \leqq M$, and to "heat the image peeling layer into a softened state" can be achieved by setting the surface temperature (M) of the hot-melt resin within a range of $Tg \leqq M \leqq mp+10$.

For an image peeling member according to the present invention, (3) an image peeling belt having an image peeling layer containing hot-melt resin provided on the surface of a heat-resisting belt substrate named as a preferred embodiment. If such an embodiment of image peeling member is used, since the amount of heat transfer in the direction of the plane of the belt is small, it is possible to effectively provide a temperature difference set by the first and second heating members, and at the same time, since less heat is accumulated, it is possible to stably maintain a desired temperature range, over a long period of time, controlled in such a manner that the resin of the image peeling layer is caused to be in a molten or softened state during a cycle of a revolution of the belt.

Also, in the embodiment of the foregoing (3), (4) there is preferably provided a guide member for curving the conveying direction of the image peeling belt on the downstream side of a heating area of the foregoing first heating member, the image peeling layer is caused to come into contact with the recording medium in the heating area of the foregoing first heating member, and thereafter, the recording medium is separated from the image peeling layer in a flection area of the image peeling belt using the foregoing guide member.

According to this structure, the conveying direction of the image peeling belt can be curved at a high curvature at the separating portion from the recording medium, and therefore, it is possible to easily separate the recording medium from the image peeling layer without providing any peeling member, peeling pawl or the peeling layer like by taking advantage of the stiffness of the recording medium.

(5) With respect to the foregoing image peeling belt, both the foregoing first and second heating members are preferably used as heating rolls so as to tension the image peeling belt between the foregoing two heating rolls.

By using the heating members as heating rolls, it is possible to cause the heating member and the belt to contact with each other using the tension of the belt for effectively transmitting heat to the image peeling belt, and increasing the thermal efficiency, and it becomes also possible to simplify the apparatus by using at least one heating roll as a driving roll as well.

Also, an image-forming material removing apparatus according to the present invention is (6) preferably in a view of obtaining the sustaining effect provided with a layer thickness regulating member, in the heating area of the foregoing second heating member, for regulating the thickness of the image peeling layer made of hot-melt resin formed on the surface of the heat-resisting belt-shaped substrate of the image peeling member. This layer thickness regulating member is provided to face to the second heating member, and is capable of regulating by physically removing the layer thickness by portions of the image peeling layer and the toner peeled which have entered a molten state. Therefore, it is possible to significantly reduce the driving torque applied to the image peeling member as compared with a method for regulating the layer thickness by a mechanical force, to regulate the thickness of the peeling layer after the regulation with high precision, and to maintain the peeling property over a long period of time.

As an embodiment of the layer thickness regulating member specified in (6), (7) there is named a layer thickness regulating blade arranged at a fixed spacing from the base material of the image peeling member. By the use of a blade as the layer thickness regulating member, it is possible to significantly reduce the viscosity resistance which the image peeling layer undergoes on passing through the layer thickness regulating unit, leading to reduced driving torque of the image peeling belt, and it becomes possible to downsize the apparatus and to improve the efficiency.

As a preferred embodiment for the layer thickness regulating blade specified in (7), (8) there is named an embodiment in which the blade is arranged such that the end face on the side, on which the layer thickness is regulated, faces vertically above the other end opposite thereto, the image-forming material in a molten state, which has been removed from the foregoing recording medium and shifted to the image peeling member, is peeled by the end face on the side, on which the layer thickness is regulated, and is caused to drop in a collection vessel arranged below the layer thickness regulating blade for collection. By directing the side of the blade for regulating the layer thickness upwardly, the image-forming material, which accumulates on the upstream of the blade by the regulation of the layer thickness, is caused to flow to the other end of the blade in a molten state, and further can be caused to drop in the collection portion by gravity. Therefore, it is possible to continuously collect the image-forming material by a simple method, and to perform efficient collection without affecting the surrounding environment. Since the process to the collection is performed in a molten state, there is not any fear that the resin material removed from the surface of the image peeling layer scatters in powder within the apparatus.

In an image-forming material removing apparatus according to the present invention, (9) the image peeling layer formed on the surface of the image peeling member preferably contains the same heat-melt resin material as the hot-melt resin contained in the image-forming material to be peeled. By using, for example, the same one as the hot-melt resin contained in the image-forming material such as toner for the hot-melt resin, it is possible to continuously peel the image-forming material and to continuously maintain stable peeling property without any changes in temperature-characteristics of the image peeling layer even when the hot-melt resin on the image peeling member is mixed with the image-forming material.

DETAILED DESCRIPTION OF PREFERRED EMBODIMENT

Hereinafter, with reference to the accompanying drawings, a description will be made of the present invention.

Figure 1:
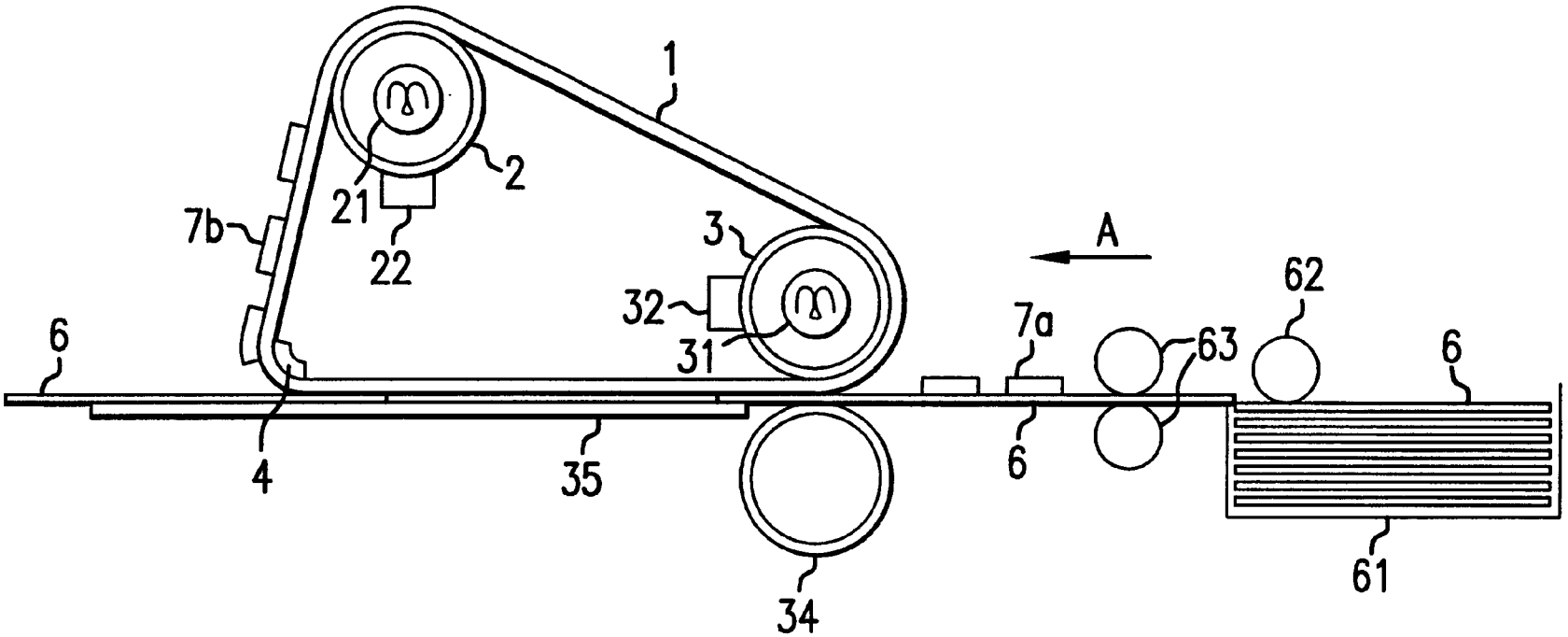
FIG. 1 is a schematic structural view showing an embodiment of an image-forming material removing apparatus according to a first embodiment.

FIG. 1 is a schematic structural view showing an image-forming material removing apparatus for use in the following first embodiment according to the present invention. An image peeling belt 1 used as an image peeling medium in the present embodiment is obtained by forming an image peeling layer containing heat-melt resin on the surface of a belt substrate made of polyimide which is a substrate. For this substrate, suitable material and thickness can be appropriately selected in consideration of strength, durability, dimensional stability against heat and the like. In other words, in addition to the polyimide belt, it can be selected from among polyamide, polyamide-imide and the like as resin material, or stainless steel, nickel and the like as a metallic belt.

As the thickness of an image peeling heat-melt resin layer formed on the substrate, 20 to 200 $\mu$m, preferably 50 to 100 $\mu$m are used.

This image peeling belt 1 is tensioned between a heating roll 2, a heating roll 3 and a sheet separating plate 4, and tension is imparted through the heating roll 2 by a pressing mechanism (not shown). The heating roll 2 is made of steel, has a heating source arranged within the shaft core therein, and a temperature sensor 22 is in contact with the surface which is not in contact with the belt 1. This heating source may be either a contact type or a non-contact type, and for example, a heater element such as a heater, or a lamp such as a halogen lamp and an infrared lamp may be used if only temperature control is easy.

The heating roll 3 is obtained by covering the outside of a roll made of steel with a silicone rubber layer, a heating source is arranged within the shaft core therein, and a temperature sensor 32 is in contact with the surface not in contact with the belt 1. A gear is mounted to one side of the heating roll 3 in the axial direction, and the driving force is transmitted thereto from a driving unit (not shown) to drive the belt 1.

The halogen lamps 21 and 31 are respectively independently feedback-controlled through measuring signals from a temperature controller (not shown) and the temperature sensors 22 and 32, whereby the temperatures of the heating rolls 2 and 3 are controlled to predetermined temperatures in conformity with desired physical properties of the thermoplastic resin forming the image peeling layer.

Facing to the heating roll 3, a pressing roll 34, whose surface is provided with a silicone rubber layer, is urged in a direction indicated by A in the figure by a pressing mechanism (not shown). A sheet separating plate 4 is a plate made of steel, whose surface has a curved surface with a radius of curvature of 3 mm and has been subjected to Teflon treatment, and the image peeling belt is adapted to smoothly slide along the curved surface. A reference numeral 35 designates a sheet chute provided along a sheet conveying passage.

Next, a description will be made of an image-forming material peeling process using an image-forming material removing apparatus according to the present invention.

Figure 2:
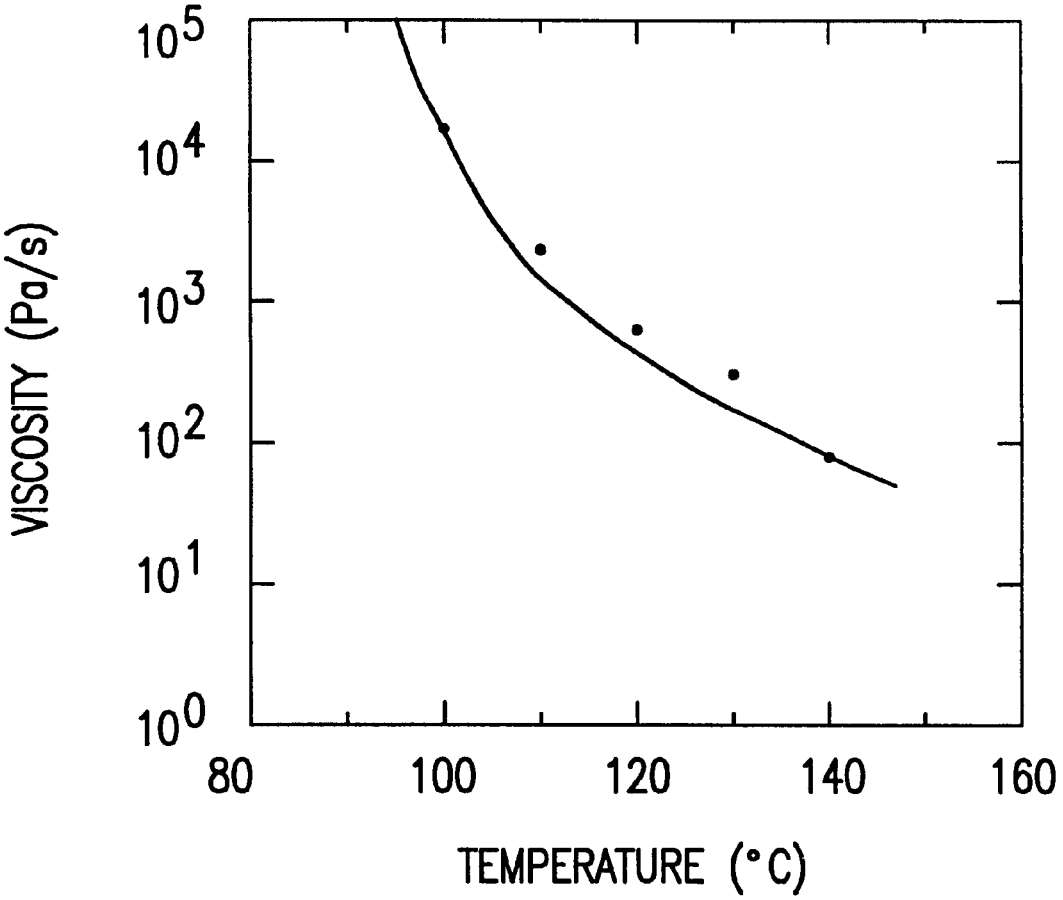
FIG. 2 is a graph showing the relation between temperature and viscosity of resin provided on the surface of an image peeling belt usable for an image-forming material removing apparatus according to the present invention.

A target object for the image-forming material peeling of an image-forming material removing apparatus in this embodiment is a recorded sheet on which an image has been formed using a special-purpose sheet on which silicone resin has been formed on a piece of ordinary paper at a thickness of such a degree (about 1 $\mu$m) that the projections and depressions of the paper are not impaired. Image formation is performed by transferring color toner onto this special-purpose sheet by a general image forming apparatus of the color electrophotographic type and further heating and fixing. Color toner is obtained by causing toner resin mainly composed of polyester resin to contain at least pigment of yellow, magenta, cyan and black respectively, and the thermal characteristics of polyester resin for use are such that the glass transition point is about 60 to 70° C., and the melting temperature is about 110 to 120° C. FIG. 2 is a graph showing relation between temperature and viscosity of representative polyester. As shown in this graph, the polyester is sharp-melt resin whose viscosity suddenly decreases as temperature rises in a temperature area which exceeds the glass transition point.

A recorded sheet 6 on which an image has been formed on this surface using image-forming material such as toner is housed on a tray 61. The sheets are fed out one sheet at a time from the tray 61 at predetermined intervals by a feeding-out roll 62, and is fed to the image-forming material peeling unit by a pair of conveying rolls 64.

The hot-melt resin used on the surface of the image peeling belt 1 is the same as polyester resin contained in the toner used for the image formation. The image peeling belt 1 is rotationally driven by the heating roll 3, and the heating roll 2 (second heating member) is temperature-controlled at 150° C. (mp+35° C.), which is sufficiently higher than the melting temperature of the polyester resin, while the heating roll 3 (first heating member) is temperature-controlled at 115° C. (mp+0° C.), which is substantially equal to the melting temperature of polyester resin. Since the image peeling belt 1 is in contact with the heating rolls 2 and 3 for a sufficient period of time, the temperature of the heat-melt resin on the peeling belt 1 immediately before they are separated from each other is substantially the same as the set temperatures for the heating rolls 2 and 3. The polyester resin on the image peeling belt 1 is heated up to a temperature sufficiently higher than the melting temperature on the heating roll 2, and is in a molten state. Thereafter, the heat is dissipated into air and it is gradually cooled while conveyed to the second heating roll, and then is heated up to temperatures near the melting temperature on the heating roll 3 into a softened state.

The recorded sheet 6 is conveyed from the sheet tray to a pressure contact portion between the heating roll 3 and the pressing roll 34 to come into contact with the image peeling belt 1. The polyester resin on the image peeling belt 1 is substantially at the set temperature on the heating roll 3. The temperature at this time is substantially the melting temperature of polyester resin, and the image peeling resin layer is in a state of having an adhesive force with a toner image 7*a* on the sheet 6 while maintaining rubber-like elasticity so that it adheres to the toner image 7*a* following the projections and depressions of the sheet when pressure is applied. At this time, the polyester resin and toner on the image peeling belt 1 are controlled by the foregoing temperature condition, and therefore, they enter a fluid state, and that they permeate through the interior of the sheet does not occur.

After passing through the pressure contact portion, the image peeling belt 1 is conveyed while maintaining the contact state with the sheet 6. During this period of time, the heat of the image peeling belt 1 is transmitted to the sheet 6 while heat is dissipated into the atmosphere, and the image peeling belt 1 and the sheet 6 reach the substantially same temperature, advancing to the separating portion.

The temperature at the image peeling belt 1 at the separating portion is, in the case of this image-forming material removing apparatus, at 80 to 90° C. (Tg+10° C. to Tg+20° C.), which is slightly higher than the glass transition point of the resin of the image peeling layer, and the image peeling layer and the toner become highly viscous and have high flocculation force, but are still in a state having rubber-like elasticity. Therefore, when strain occurs in the sheet or toner, an interface between the sheet and the toner is in an easily-separable state. When the image peeling belt 1 is curved at a high curvature, since the toner 7 on the sheet adheres to the resin layer on the surface of the image peeling belt 1, strain occurs in the toner layer, and the stiffness of the sheet 6 itself contributes to separation of the image peeling belt 1 from the sheet 6 in a state in which the toner 7 has been peeled from the recorded sheet 6.

The sheet 6, from which the toner has been peeled, is exhausted to an exhaust sheet tray (not shown).

The toner 7*b* adhered to the image peeling belt 1 is heated together with polyester resin (thermoplastic resin) of the image peeling layer by the heating roll 2 up to a temperature (mp+30 to mp+about 50° C.), which is sufficiently higher than the melting temperature, both become less viscous and are made integral with each other by the surface tension, and the surface of the image peeling layer becomes a smooth, gloss surface.

Here, the suitable temperature condition for the heating roll will be studied. Table 1 shows the result obtained by evaluating the relation between the temperature at the image peeling layer and the peeling property of the image-forming material from the sheet when the set temperature for the heating roll (indicated by a sign 3 in FIG. 1) in the pressure contact portion is varied. The thermoplastic resin for the image peeling layer used for this evaluation is polyester resin (Tg=70° C., mp=115° C.).

The evaluation has been performed in accordance with the following standard:

Good: No toner can be seen on the recording medium.

Moderate: A thin residual toner image can be seen on the recording medium.

Bad: A toner image remaining on the recording medium can be confirmed.

When the temperature at the image peeling layer is lower than the glass transition point temperature of resin (M<Tg), no peeling can be performed. The reason is presumed to be that, since the temperature at the image peeling belt is too low, no adhesive force is produced.

TABLE 1

| Set temperature for heating roll (° C.) | Resin layer surface temperature (° C.) | Peeling property | Remarks |
|---|---|---|---|
| 80> | 80> | Bad | M < mp − 35° C. |
| 80≦ | 80≦ | Moderate | mp − 35° C. ≦ M < mp − 15° C. |
| 100≦ | 100≦ | Good | mp − 15° C. ≦ M < mp + 5° C. |
| 120≦ | 120≦ | Moderate | mp + 5° C. ≦ M < mp + 25° C. |
| 140< | 140< | — | mp + 25° C ≦ M |

—: Sheet was wound around the belt.

The result in the Table 1 shows that as the resin layer surface temperature approaches the melting temperature (115° C., i.e., mp±0° C. here) beyond the glass transition point (Tg), peeling gradually becomes possible, and good peeling property is provided near the melting point, that is, within a range of 100 to 120° C. (mp−15° C.<M<mp+5° C.).

On the other hand, as the resin layer surface temperature further becomes higher beyond the melting temperature, the greater part of the recorded image can be peeled, but about 5% in image density cannot be peeled, and it remains. The reason is presumed to be that, since the temperature of toner on the sheet excessively increases at the pressure contact portion to reduce the viscosity of the resin layer, the toner resin in a fluid state permeates through the interior of the sheet, and peeling cannot be performed. This tendency becomes stronger as the temperature increases.

Therefore, it can be seen that it is necessary to make the temperature of the image peeling belt at the pressure contact portion stay near the melting temperature of resin.

Table 2 shows the result obtained by evaluating the peeling property of the image-forming material from the sheet at respective temperatures by varying the set temperature of the heating roll 2 with the temperature of the foregoing pressure contact portion fixed at 115° C. (mp±0° C.). In this respect, the evaluation standard is the same as the foregoing one.

TABLE 2

| Set temperature for heating roll (° C.) | Peeling property |
|---|---|
| 120> | Poor |
| 120≦ | Moderate |
| 140≦ | Good |

As is apparent from the result of Table 2, in the case where the image peeling layer temperature is lower than the melting temperature of resin, when continuously peeled, the surface of toner which accumulates on the image peeling layer becomes a replica of the projections and depressions of the sheet, and it lacks smoothness. Therefore, the peeling performance is greatly deteriorated in a portion (that is, portion in which the toner image has adhered to the surface) from which the image has been peeled at the immediately preceding cycle in the image peeling layer.

It has been confirmed that this tendency gradually becomes weak as the set temperature for the heating roll 3 is increased from the melting temperature, and that if it is set to mp+about 30° C., a level at which substantially no problem is presented is reached even if continuously peeled. This is because as the temperature increases and the viscosity of the resin layer becomes lower, the surface tension of the resin itself levels off the projections and depressions on the surface of the image peeling layer by means of heating in one cycle, and the surface after the temperature is increased by 30° C. is a substantially smooth, gloss surface, and is the same as the state before the peeling.

In the foregoing embodiment, the description has been made of an apparatus using two heating rolls as a heating member. It goes without saying that the present invention is not limited to this structure, but may be applicable to any arrangement wherein the image peeling layer is heated so that the viscosity of the image peeling layer enters a desired state. It may be possible to adopt such structure that a heat generating layer is formed on the surface, and the image peeling belt slides on a heating plate with a curvature. In this case, it is necessary to separately provide a driving roll for driving the image peeling belt, or it is also be possible to adopt a method for heating by means of radiation heat from the image peeling layer side. Also, with respect to a heat source for the heating roll, such a lamp as a halogen lamp, a heat generating roll having a heat generating element within the roll itself or the like can be arbitrarily used.

Also, as a method for peeling a sheet from the image peeling belt, the belt may be bent by a separating plate to separate the sheet as in the case of the foregoing embodiment, or the belt may be tensioned by a small-diameter separating roll to separate the sheet at the curvature portion. It is also possible to separate between the heating rolls or immediately after passing through the first heating roll using a separating pawl or a separating member.

Also, with respect to a method for driving the belt, the heating roll on the pressure contact portion side is used as the driving roll in the present embodiment, but it is also possible to use the other heating roll as the driving roll.

For the resin in the image peeling layer, the same material as hot-melt resin contained in toner, which is image-forming material, is used, but material of the same series having the substantially same thermal characteristics can be used if only it performs the foregoing operation. In this case, as the toner is peeled, the resin which formed the image peeling layer at the beginning and the toner resin are mixed, and this mixture constitutes the image peeling layer.

The recording medium described in the present embodiment is a special-purpose sheet obtained by forming very thin release characteristics film on a piece of ordinary paper, in which there exist microscopic holes or grooves among pulp fibers like the ordinary paper, and the image-recording material permeates through its holes and grooves in the fixing process to obtain a binding force with the recording medium due to the so-called anchor effect. For the recording medium used in the present invention, it is not limited to the foregoing structure if only the image-recording material is thus capable of exhibiting the anchor effect, and a porous plastic sheet or the like may be used. Also, with respect to release characteristics film treatment, this is a method for increasing the peeling property because the adhesion properties of the toner for use to ordinary paper are too high. If toner resin having low adhesion properties to ordinary paper is used on image recording, it is also possible to perform image peeling using ordinary paper by use of the same series of resin in the image peeling layer.

In the case where image peeling from other recording media than fibrous and porous media, i.e., OHP or a plastic sheet is performed by the foregoing image-forming material removing apparatus, a phenomenon cannot be seen that the peeling property is deteriorated by raising the set temperature for the first heating member as shown in Table 1. This is because the toner does not permeate through the interior of the recording medium during the contact. Therefore, on peeling an image from such a recording medium, it will suffice if only the first heating member heats the image peeling member at the softening temperature or more, and there is no need for temperature control with high precision.

Hereinafter, with reference to embodiments, the concrete description will be made of the present invention, but the present invention is not limited thereto.

<First Embodiment>

FIG. 1 is a schematic structural view showing an image-forming material removing apparatus according to the present embodiment.

As the image peeling medium, there is used a medium obtained by coating the surface of a belt substrate 300 mm long, 340 mm wide and 75 μm thick made of polyimide with hot-melt resin (polyester resin obtained from terephthalic acid/bisphenol A ethylene oxide additional matter/cyclohexanedimethanol, Tg=70° C., mp=115° C., Mn=4000, Mw=35000, acid number=12, hydroxide number=25) at a thickness of 75 μm. This image peeling belt 1 is tensioned between a heating roll 2, a heating roll 3 and a sheet separating plate 4, and tension is imparted through the heating roll 2 by a pressing mechanism (not shown). The heating roll 2 is a roll 25 mm in outside diameter and 0.3 mm thick, made of steel, has a halogen lamp 21 as a heating source arranged within the shaft core therein, and a temperature sensor 22 is in contact with the surface which is not in contact with the belt 1. The heating roll 3 is a roll 25 mm in outside diameter and 0.3 mm thick, made of steel, in the outside of which silicone rubber is coated at a thickness of 0.1 mm, has a halogen lamp 31 as a heating source arranged within the shaft core therein, and a temperature sensor 32 is in contact with the surface which is not in contact with the belt 1. A gear is mounted on one side of the heating roll 3 in the axial direction, and a driving force is transmitted by a driving unit (not shown) to drive the belt 1.

The halogen lamps 21 and 31 are respectively feedback-controlled through measuring signals from a temperature controller (not shown) and the temperature sensors 22 and 32, whereby the temperatures of the heating rolls 2 and 3 are controlled to stay at predetermined temperatures.

Facing to the heating roll 3, a pressing roll 34, whose surface is provided with a silicone rubber layer, is urged in a direction indicated by A in the figure by a pressing mechanism (not shown). A sheet separating plate 4 is a plate made of steel, whose surface has a curved surface with a curvature radius of 3 mm and has been subjected to Teflon treatment, and the image peeling belt 1 is adapted to smoothly slide along the curved surface. A reference numeral 35 designates a sheet chute provided along a sheet conveying passage.

A target object for the image-forming material peeling in an image-forming material removing apparatus in the present embodiment is a recorded sheet on which an image has been formed using a special-purpose sheet on which silicone resin has been formed on a piece of ordinary paper at a thickness of such a degree (about 1 μm) that the projections and depressions of the paper are not impaired. Image formation is performed by transferring color toner onto the special-purpose sheet having this surface layer formed thereon, by an image forming apparatus of the color electrophotographic type and further by heating and fixing. Color toner is obtained by causing a polyester resin to contain at least pigment of yellow, magenta, cyan and black respectively, and the thermal characteristics of polyester resin for use are such that the glass transition point is about 70° C., and the melting temperature is about 115° C. As previously described in FIG. 2, the polyester is sharp-melt resin whose viscosity suddenly decreases as temperature rises in a temperature area which exceeds the glass transition point.

This recorded sheet 6 is housed on a tray 61. The sheets 6 are fed out one sheet at a time at predetermined intervals from the tray by a feeding-out roll 62, and are fed to the image-forming material peeling unit by a pair of conveying rolls 64.

The hot-melt resin used on the surface of the image peeling belt 1 is the same as polyester resin contained in the toner used for the image formation. The image peeling belt 1 is rotationally driven at a speed of 80 mm/s by the heating roll 3, and the heating roll 2 is temperature-controlled at 150° C. (mp+35° C.), which is sufficiently higher than the melting temperature of the polyester resin, while the heating roll 3 is temperature-controlled at 115° C. (mp±0° C.), which is substantially equal to the melting temperature of polyester resin. The polyester resin constituting an image peeling layer formed on the surface of the image peeling belt 1 is heated up to a temperature sufficiently higher than the melting temperature on the heating roll (second heating member) 2, and is in a molten state. Thereafter, the heat is dissipated into air and the polyester resin is gradually cooled while conveyed to the heating roll (first heating member) 3, and then is heated up to temperatures near the melting temperature on the heating roll 3 into a softened state.

The recorded sheet 6 is conveyed from the sheet tray to a pressure contact portion between the heating roll 3 and the pressing roll 34 to come into contact with the image peeling belt 1. The polyester resin on the image peeling belt 1 has its surface temperature maintained substantially at temperatures near the melting temperature, and is in a state (molten or softened state) having adhesive force with the toner image on the sheet 6 while having rubber-like elasticity so that it adheres to the toner image 7*a* following the projections and depressions of the sheet 6 when pressure is applied.

After passing through the pressure contact portion, the image peeling belt 1 is conveyed while maintaining the contact state with the sheet 6. During this period of time, the heat of the image peeling belt 1 is transmitted to the sheet 6 while the heat is dissipated into the atmosphere, and the image peeling belt 1 and the sheet 6 have the substantially same temperature, advancing to the separating portion.

The temperature of the image peeling belt 1 at the separating portion is, in the case of this image-forming material removing apparatus, at 80 to 90° C., which is slightly higher than the glass transition point of the resin of the image peeling layer, and the image peeling layer and the toner become highly viscous and have high flocculation force, but are still in a state having rubber-like elasticity. When the image peeling belt 1 is bent at a high curvature, since the toner on the sheet 6 adheres to the image peeling layer on the surface of the image peeling belt 1, strain occurs in the toner layer, and the stiffness of the recording medium itself contributes to separation of the image peeling belt 1 from the sheet 6 in a state in which the toner has been peeled from the recorded sheet 6, and the toner (image-forming material) moves from the sheet 6 to the surface of the image peeling layer.

The toner is peeled here, and the recycled sheet 6 is exhausted to an exhaust sheet tray (not shown).

The toner 7*b* adhered to the image peeling belt 1 is heated again together with polyester resin of the image peeling layer by the heating roll (second heating member) 2 up to a temperature, which is sufficiently higher than the melting temperature, both become less viscous and are made integral with each other by surface tension, and the surface of the image peeling layer becomes a smooth, gloss surface. Therefore, the image peeling property is not deteriorated even in the next cycle, and can be repeatedly used.

<Second Embodiment>

Figure 3:
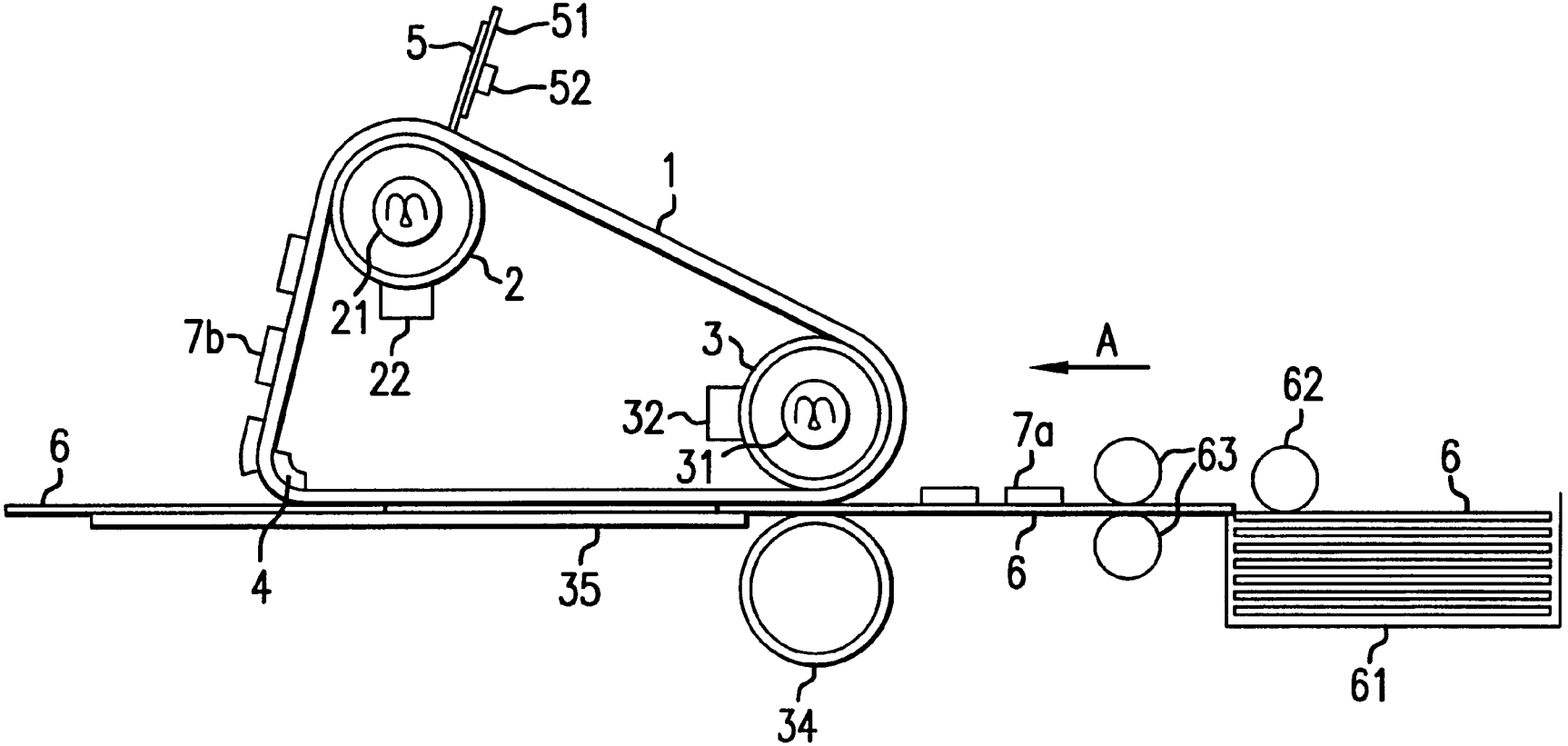
FIG. 3 is a schematic structural view showing an embodiment of an image-forming material removing apparatus according to a second embodiment.

FIG. 3 is a schematic structural view showing an image-forming material peeling apparatus according to the present embodiment. Although almost all parts are the same as in the apparatus shown in the first embodiment, layer regulating blades 5, each of which is a layer regulating member, are supported at regular intervals in the axial direction in parallel to the heating roll 2 facing the heating roll 2 on the downstream side in the direction of rotation of image peeling belt 1 wound along the heating roll 2. The layer regulating blade 5 is made of stainless steel, having a thickness of 0.5 mm, and has a ceramic heater 51 mounted on the back thereof. The ceramic heater 51 has a temperature sensor 52 in contact therewith, and is feedback-controlled by a temperature controller (not shown) so that the temperature of the layer regulating blade 5 is kept constant.

In this respect, in the image-forming material peeling apparatus shown in FIG. 3, the first heating member (heating roll) 3 and the sheet separating plate 4 are arranged to be apart from each other at a predetermined distance. In this case, the toner 7*a* and the image peeling belt 1, which have been heated by the first heating member 3, are sufficiently cooled while they are conveyed to the position of the sheet separating plate 4, and the internal flocculation force of the toner 7*a* increases to make peeling easier. However, this first heating member 3 and the sheet separating plate 4 can be sufficiently peeled even if they are brought extremely close to each other, for example, 50 mm or less. The reason is presumed to be that the toner 7*a*, which has come into contact with the first heating member 3, is heated through the image peeling belt 1, and is made integral with the hot-melt resin on the image peeling belt 1 while it is in contact with the first heating member 3. The surface temperature of the toner 7*a* has already become somewhat lower before this contact because of heat dissipation from the sheet 6 on the back of the toner 7*a*, and transfer of the toner 7*a* from the sheet 6 onto the image peeling belt 1 has been terminated. Therefore, even if the sheet separating plate 4 is provided immediately behind the first heating member 3, it is sufficiently possible to peel the toner 7*a* from the sheet 6, and in this case, the main function of the sheet separating plate 4 is considered to physically peel the sheet 6 from the image peeling belt 1.

Consequently, the structure is arranged such that there is provided a curvature sufficient for the sheet 6 to peel from the image peeling belt 1 in the area in contact with the first heating member 3, whereby the first heating member 3 can be made integral with the sheet separating plate 4. In other words, the sheet separating plate 4 can be omitted by controlling the shape and size of the first heating member 3.

Figure 4:
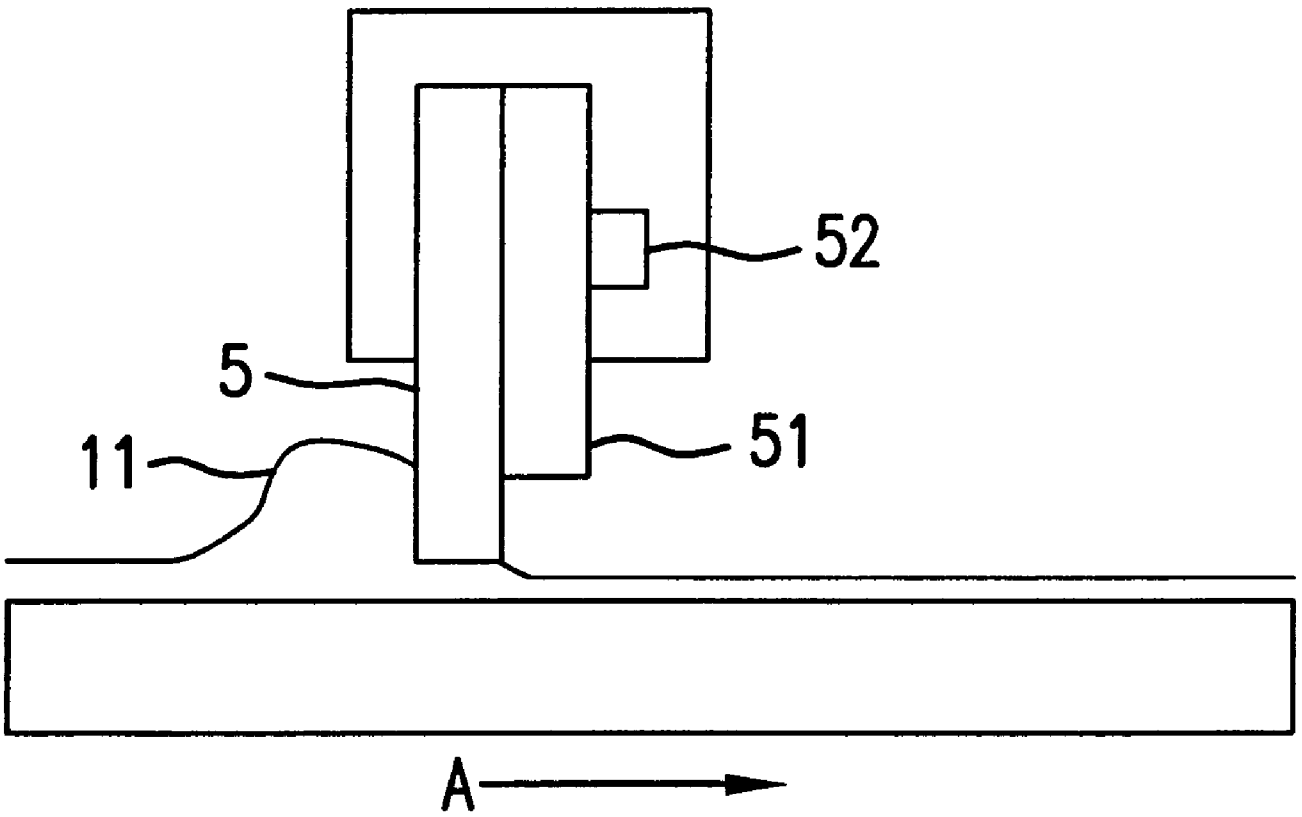
FIG. 4 is a schematic structural view showing an embodiment of a general-purpose layer regulating blade for use in an image-forming material removing apparatus according to the present invention.

Next, a description will be made of a method for regulating the image peeling layer using the layer regulating blade 5. The layer regulating blade 5 is set such that the interval between it and the base material for the image peeling belt 1 becomes 100 $\mu$m, and is set to 150° C. in temperature. The peeling is continuously performed, and the toner on the image peeling layer becomes gradually thicker. When the thickness exceeds the gap, the tip end of the blade 5 comes into contact with the image peeling layer. FIG. 4 is an enlarged view showing the layer regulating portion in a state in which the thickness of the image peeling layer has become thicker than the gap (interval of 100 $\mu$m). Since the temperature of the image peeling layer in this area is higher than the melting temperature (mp) of the hot-melt resin, the image peeling layer shows behavior of fluid, the thickness of the image peeling layer after passing through the blade 5 becomes substantially a half the gap, and resin scrapped accumulates on the upstream side of the blade. The image peeling layer, which has passed through, exists on the image peeling belt 1 from the beginning, and is in a state in which the hot-melt resin and the toner obtained by peeling from the sheet 6 are mixed. Since both resin use the same material, they have high compatibility and their peeling performance remains unchanged even after the peeling.

Even when peeling of toner from the sheet is continued and toner excessively accumulates on the image peeling layer, it is possible to prevent the thickness of the image peeling layer from exceeding a fixed level by means of the layer regulating blade. When the image peeling layer becomes too thick, the heat capacity of the image peeling belt becomes large, and therefore, there arises the problem that it becomes difficult to set the temperatures of the image peeling layer at each position at desired temperatures. Since, however, this can also be prevented, it is possible to perform good peeling continuously.

In the present embodiment, the description has been made of an image-forming material removing apparatus in which the blade 5 as the layer regulating member is arranged such that the tip end of the blade is pointed downward vertically, and it is perpendicular to the tangential direction of the heating roll in the section, and in which the heating roll and the sheet feeding system have been arranged to match the arrangement of the blade, but the positional relationship between the blade and the apparatus is not limited thereto as a matter of course.

Figure 5:
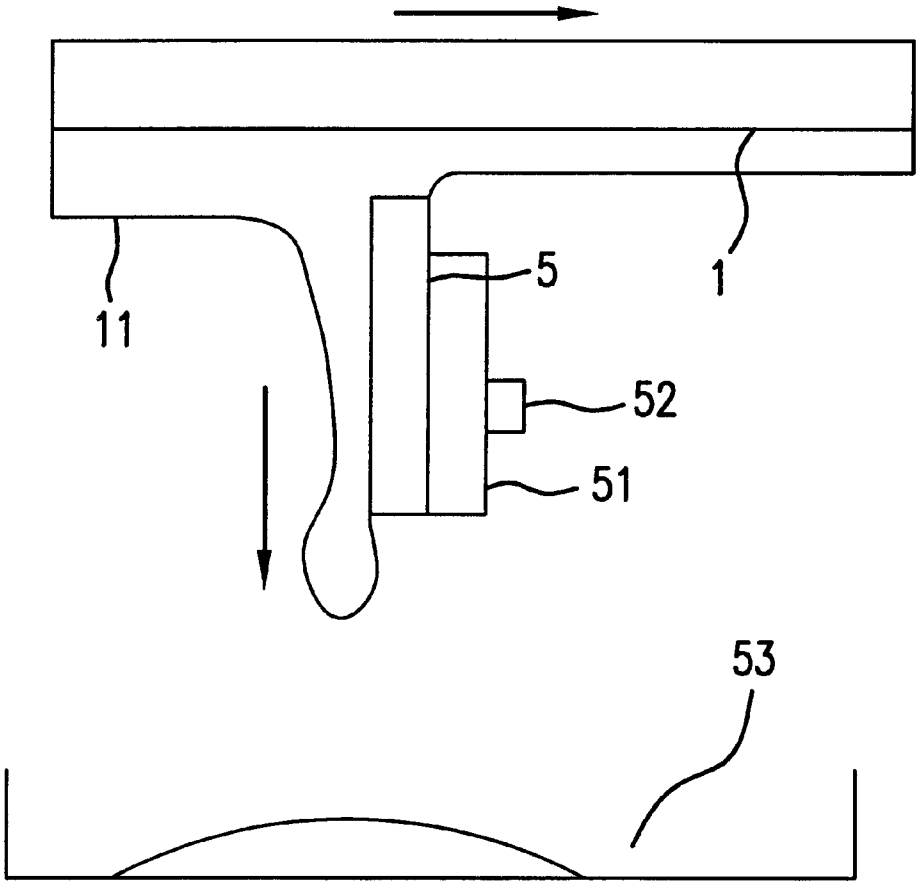
FIG. 5 is a schematic structural view showing an embodiment of a layer regulating blade in which a regulating end for use in the image-forming material removing apparatus according to the present invention has been provided so as to face upwardly.

In an image-forming material removing apparatus in which the blade is set such that its tip end is pointed vertically upward and its rear end is placed downward as shown in FIG. 5, and the image peeling belt 1 is arranged so as to match the arrangement, the layer thickness is regulated, the image-forming material removed from the image peeling layer flows toward the blade rear end in a molten state by gravity, and further drops from the blade 5, and therefore, the toner peeled can be collected with simple structure if there is provided a collection box 53 vertically below the blade 5.

In the foregoing, the description has been made of a layer regulating member, comprising a stainless blade provided with a ceramic heater, but a method for regulating the image peeling layer in a molten state to a fixed thickness facing to the heating roll is not limited thereto, and as, for example, the blade, a metallic blade such as steel, aluminum and brass or a ceramic plate or the like can be used, or it is possible to support it at regular intervals in a stationary state using a metallic heating roll, or to rotate it in the direction opposite to the advance direction of the belt. At this time, in order to heat the layer regulating member at a fixed temperature in advance, it is possible to support, for example, a halogen lamp within, or to provide a resistance heating layer on the surface of the roll.

As described above, according to an image-forming material removing apparatus of the present invention, since the toner peeled reaches the temperatures at which it enters a molten state in one cycle, the surface is made smooth, and the high peeling property at the beginning can be maintained even if peeling is continuously performed. Further, by regulating the layer of the image peeling layer in the molten state, it is possible to regulate and collect the peeled toner which accumulates on the image peeling layer with simple structure, and to peel the image-forming material from the sheet with stability over a long period of time. As a result, it becomes possible to reuse the recording sheets with high productivity, thus greatly reducing sheets scrapped from business offices.

EFFECT OF THE INVENTION

An image-forming material removing apparatus according to the present invention exhibits an excellent effect that image-forming material such as toner can be continuously peeled from a recording medium while, with simple structure, maintaining the material's high quality.

What is claimed is:

1. An image forming material removing apparatus for removing image forming material containing hot-melt resin from a recording medium on which said image-forming material has melted and adhered, comprising:

an image peeling member provided with an image peeling layer containing hot-melt resin on a surface of a heat-resisting base member;

a first heating member for heating said image peeling layer into a softened or molten state;

a contacting unit that causes said image peeling layer which has been heated by said first heating member and brought into a softened or molten state to come into contact with a recording medium onto whose surface said image-forming material has adhered;

a separating unit that separates said recording medium from said image peeling layer in a state in which said image-forming material adhered to said image peeling layer has been moved onto the surface thereof; and a second heating member for heating said image peeling layer separated from said recording medium into a molten state.

2. The image-forming material removing apparatus according to claim 1, wherein said image peeling member is an image peeling belt provided with an image peeling layer containing hot-melt resin on a surface of a heat-resisting belt-shaped substrate.

3. An image forming material removing apparatus for removing image forming material containing hot-melt resin from a recording medium on which said image-forming material has melted and adhered, comprising:

an image peeling member provided with an image peeling layer containing hot-melt resin on a surface of heat-resisting base member;

a first heating member for heating said image peeling layer into a softened or molten state;

a contacting unit that causes said image peeling layer which has been heated by said first heating member and brought into a softened or molten state to come into contact with a recording medium onto whose surface said image-forming material has adhered;

a separating unit that separates said recording medium from said image peeling layer in a state in which said image-forming material adhered to said image peeling layer has been moved onto the surface thereof; and a second heating member for heating said image peeling layer separated from said recording medium into a molten state, wherein said image peeling member is an image peeling belt provided with an image peeling layer containing hot-melt resin on a surface of a heat-resisting belt-shaped substrate, and wherein there is provided a guide member for curving the conveying direction of the image peeling belt downstream of a heating area of said first heating member, the image peeling layer is caused to come into contact with the recording medium in the heating area of said first heating member, and thereafter, the recording medium is separated from the image peeling layer at a curving area of the image peeling belt by said guide member.

4. The image-forming material removing apparatus according to claim 2, wherein said first and second heating members are both heating rolls, and said image peeling belt is tensioned between said two heating rolls.

5. The image-forming material removing apparatus according to claim 2, further comprising a layer thickness regulating member, in the heating area of said second heating member, for regulating the thickness of the image peeling layer made of hot-melt resin formed on the surface of the heat-resisting belt-shaped substrate of the image peeling member.

6. The image-forming material removing apparatus according to claim 5, wherein said layer thickness regulating member is a layer thickness regulating blade arranged at a fixed spacing from the base material of the image peeling member.

7. The image-forming material removing apparatus according to claim 6, wherein said layer thickness regulating blade is arranged such that an end face on the side, on which the layer thickness is regulated, faces vertically above the other end opposite thereto, the image-forming material in a molten state, which has been removed from said recording medium, and shifted to the image peeling member, is peeled by the end face on the side, on which the layer thickness is regulated, and is caused to drop into a collection vessel arranged below the layer thickness regulating blade for collection.

8. The image-forming material removing apparatus according to claim 2, wherein the image peeling layer formed on the surface of said image peeling member contains the same hot-melt resin material as the hot-melt resin contained in the image-forming material to be peeled.

9. The image-forming material removing apparatus of claim 1, comprising a first heating member for heating said image peeling layer into a softened state, and a contacting unit that causes said image peeling layer which has been heated by said first heating member and brought into a softened state to come into contact with a recording medium onto whose surface said image-forming material has adhered.

10. The image-forming material removing apparatus of claim 3, comprising a first heating member for heating said image peeling layer into a softened state, and a contacting unit that causes said image peeling layer which has been heated by said first heating member and brought into a softened state to come into contact with a recording medium onto whose surface said image-forming material has adhered.

11. The image-forming material removing apparatus according to claim 3, wherein said first and second heating members are both heating rolls, and said image peeling belt is tensioned between said two heating rolls.

12. The image-forming material removing apparatus according to claim 3, further comprising a layer thickness regulating member, in the heating area of said second heating member, for regulating the thickness of the image peeling layer made of hot-melt resin formed on the surface of the heat-resisting belt-shaped substrate of the image peeling member.

13. The image-forming material removing apparatus according to claim 12, wherein said layer thickness regulating member is a layer thickness regulating blade arranged at a fixed spacing from the base material of the image peeling member.

14. The image-forming material removing apparatus according to claim 13, wherein said layer thickness regulating blade is arranged such that an end face on the side, on which the layer thickness is regulated, faces vertically above the other end opposite thereto, the image-forming material in a molten state, which has been removed from said recording medium, and shifted to the image peeling member, is peeled by the end face on the side, on which the layer thickness is regulated, and is caused to drop into a collection vessel arranged below the layer thickness regulating blade for collection.

15. The image-forming material removing apparatus according to claim 3, wherein the image peeling layer formed on the surface of said image peeling member contains the same hot-melt resin material as the hot-melt resin contained in the image-forming material to be peeled.

* * * * *